US007052740B2

(12) United States Patent
McNulty

(10) Patent No.: US 7,052,740 B2
(45) Date of Patent: May 30, 2006

(54) FRAME ASSEMBLY AND METHOD FOR COATING A STRAND OF WORKPIECES

(75) Inventor: Todd McNulty, Harrison Township, MI (US)

(73) Assignee: Apollo Plating, Inc., Roseville, MI (US)

( * ) Notice: Subject to any disclaimer, the term of this patent is extended or adjusted under 35 U.S.C. 154(b) by 514 days.

(21) Appl. No.: 10/255,827

(22) Filed: Sep. 26, 2002

(65) Prior Publication Data

US 2004/0069642 A1 Apr. 15, 2004

(51) Int. Cl.
*B05D 1/18* (2006.01)
*B05C 13/00* (2006.01)

(52) U.S. Cl. ..... 427/458; 427/435; 427/436; 427/437; 427/443.2; 118/428; 118/500; 118/503

(58) Field of Classification Search ..... 427/458, 427/435, 436, 437, 443.2; 118/428, 500, 118/503

See application file for complete search history.

(56) References Cited

U.S. PATENT DOCUMENTS 2,572,838 A * 10/1951 Cohn ..... 205/149
4,470,884 A 9/1984 Carr
4,534,843 A * 8/1985 Johnson et al. ..... 204/202
5,098,749 A 3/1992 Gabriel et al.
5,234,562 A 8/1993 Uenishi et al.
5,639,306 A * 6/1997 Gradowski ..... 118/418
5,863,615 A 1/1999 Ikeda
5,951,763 A 9/1999 Knox

FOREIGN PATENT DOCUMENTS

JP 6240498 8/1994

* cited by examiner

*Primary Examiner*—Fred J. Parker
(74) *Attorney, Agent, or Firm*—Howard & Howard

(57) ABSTRACT

The subject invention includes a plating apparatus (10) having an electrically conductive rack (12) and a frame assembly (14). The frame assembly (14) includes a rod (24) and series of support structures (26). A number of removable (34) and fixed (32) bars are attached to the support structures (26) such that a strand of interconnected workpieces (18) are wrapped over the bars (32, 34) to define a revolution of the interconnected workpieces (18). The plating apparatus (10) and frame assembly (14) are characterized by a series of spacers (38) mounted along the removable bars (34) for separating adjacent revolutions of the interconnected workpieces (18) such that the workpieces (18) can be effectively coated with the material. The subject invention also includes a method of coating the strand of workpieces (18) comprising the steps of; mounting a first end of the strand to the removable bars (34); wrapping the strand over the bars (32, 34) while simultaneously wrapping the strand between adjacent spacers (38) to separate adjacent revolutions of the strand; mounting a second end of the strand to an opposite end of the removable bars (34); and coating the frame assembly (14) and strand of workpieces (18) with the material.

20 Claims, 6 Drawing Sheets

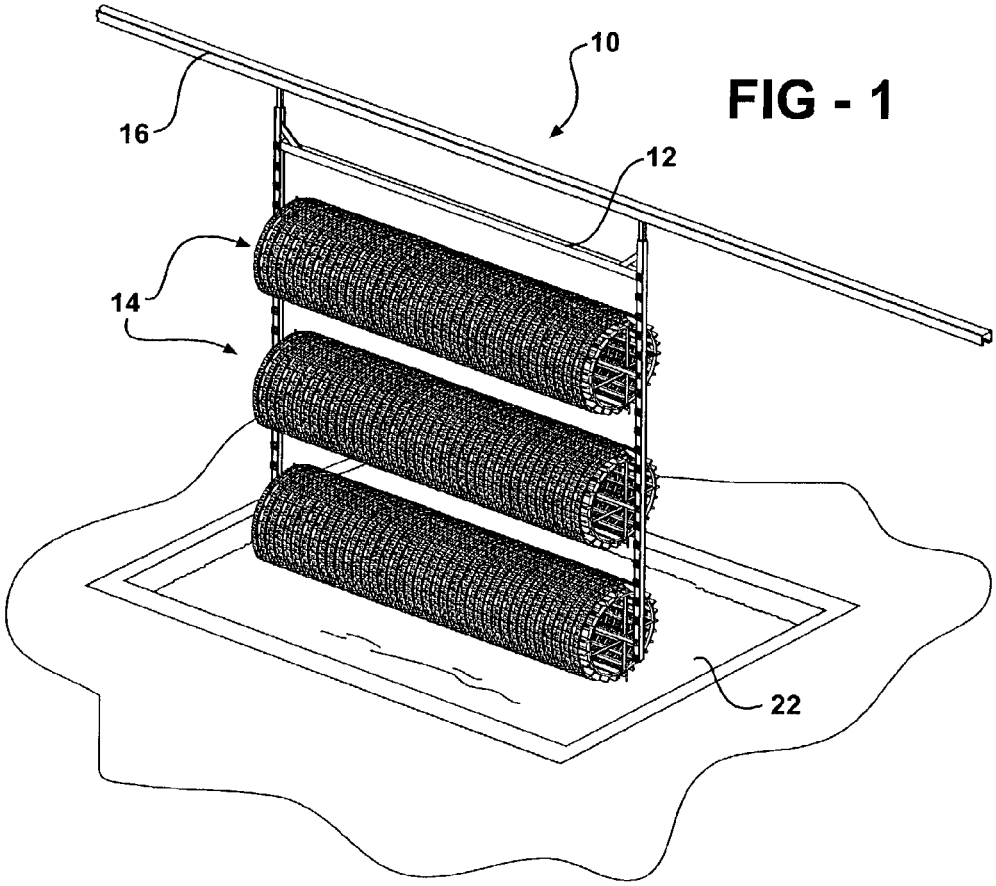
FIG - 1
FIG - 7
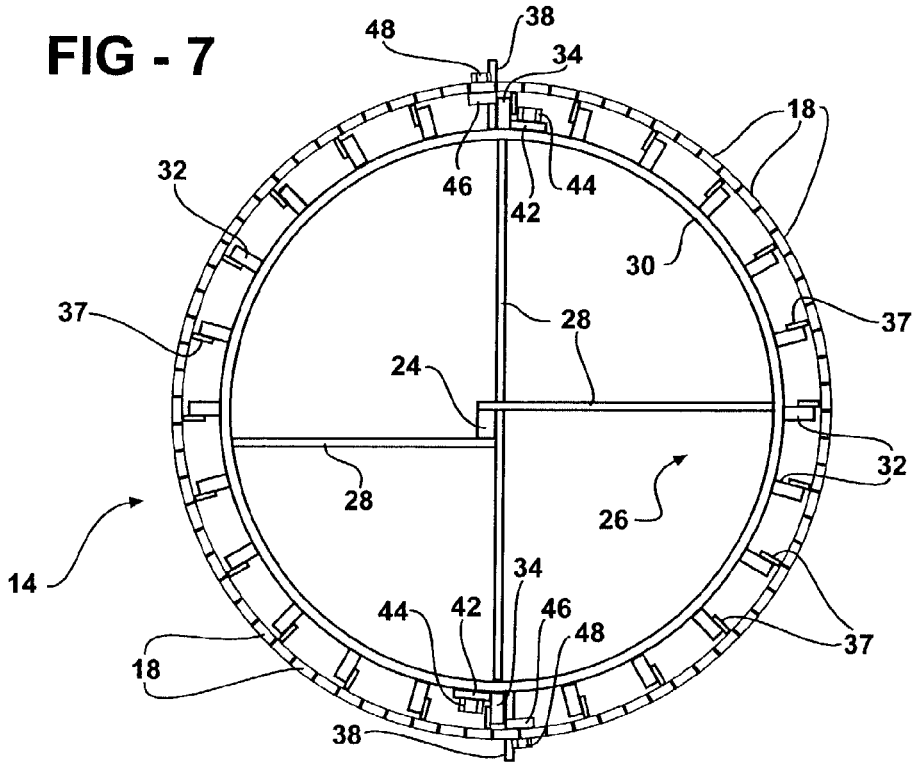

FRAME ASSEMBLY AND METHOD FOR COATING A STRAND OF WORKPIECES

BACKGROUND OF THE INVENTION

1. Field of the Invention

The subject invention relates to a plating apparatus having a frame assembly for coating a strand of workpieces.

2. Description of the Prior Art

The coating or plating of metal parts with zinc, nickel, and/or chromate material is known in the art. The coated metal parts have an improved appearance and are corrosion resistant. One common method for coating the parts is to manually mount the metal parts onto a rack and subsequently dip the entire rack, with the parts, into a series of baths. The baths can perform a number of functions including cleaning, rinsing, and drying the metal parts. One or more of the baths will also plate the metal parts with the desired material. This method is effective when the metal parts are easily installed and removed from the rack, i.e., the parts are relatively large.

Mounting small metal parts, such as nuts, to the rack is not practical. Hence, these small metal parts are typically coated or plated by using other methods. One such alternative method is to place the small metal parts into a barrel. The barrel can then be mounted to a rack and dipped in the baths. The barrel has a number of small openings to allow the intrusion of the materials into the barrel. The barrel is rotated such that the small metal parts tumble within the barrel and become coated with the material. The barrel method of coating small metal parts has a number of deficiencies. In particular, the barrel itself, which has a relatively large surface area, is coated along with the metal parts thereby wasting the coating material. The barrel is also relatively heavy and cumbersome to maneuver. In addition, the tumbling of the metal parts is undesirable in that some surface areas may not be coated, some of the metal parts may be damaged, and/or some of the material may chip off.

Accordingly, it would be desirable to develop a coating or plating apparatus that can effectively coat or plate small metal parts with a material while avoiding the deficiencies of the prior art outlined above.

SUMMARY OF THE INVENTION AND ADVANTAGES

The subject invention includes a plating apparatus for supporting a plurality of workpieces such that the workpieces can be coated with a material. The plating apparatus having an electrically conductive rack and a frame assembly. The frame assembly comprising a rod defining a longitudinal axis and being mounted to the rack. A plurality of supports each mounted to the rod and extending radially outwardly therefrom. A plurality of bars attached to the supports wherein the interconnected workpieces are wrapped over the bars about the longitudinal axis to define a revolution of the interconnected workpieces. The plating apparatus and frame assembly are characterized by a plurality of spacers mounted along at least one of the bars for separating adjacent revolutions of the interconnected workpieces such that the workpieces can be effectively coated with the material.

The subject invention also includes a method of coating the strand of workpieces. The method comprising the steps of; mounting a first end of the strand to an end of one of the bars; wrapping the strand over the bars to define a revolution of the strand; wrapping the strand between adjacent spacers while wrapping the strand over the bars to simultaneously separate adjacent revolutions of the strand; mounting a second end of the strand to an opposite end of one of the bars; and coating the frame assembly and strand of workpieces with the material.

Accordingly, the subject invention provides for a plating apparatus having a lightweight and versatile frame assembly which can effectively and thoroughly coat or plate small metal parts with a material without wasting material or damaging the metal parts.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is perspective view of a plating apparatus positioned over a bath in accordance with the subject invention;

FIG. 7 is an end view of the frame assembly; and

DETAILED DESCRIPTION OF THE PREFERRED EMBODIMENT

Figure 2:
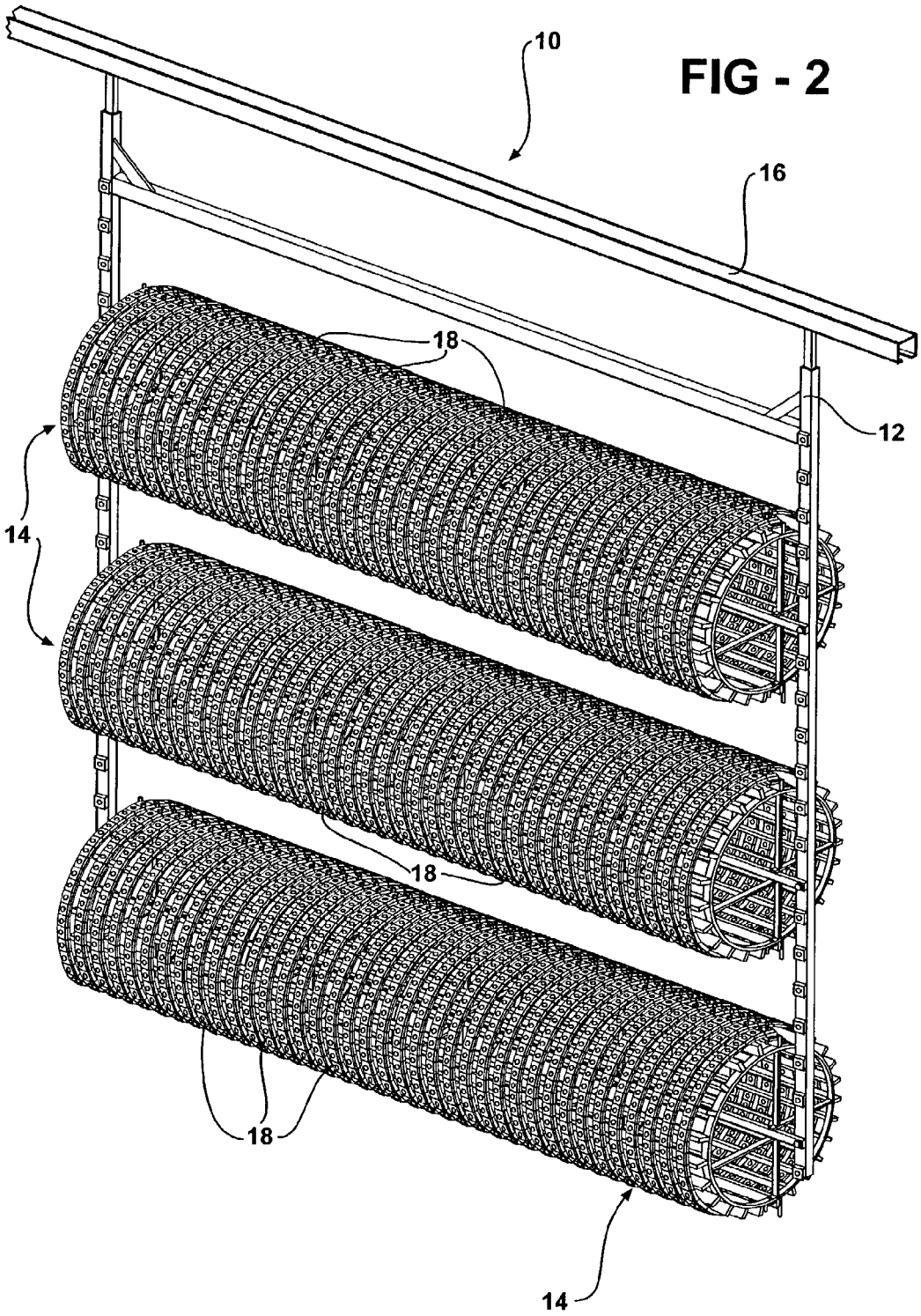
FIG. 2 is a perspective view of the plating apparatus.

Referring to the Figures, wherein like numerals indicate like or corresponding parts throughout the several views, a plating apparatus is generally shown at 10 in FIGS. 1 and 2. The plating apparatus includes an electrically conductive rack 12 and at least one frame assembly 14. As illustrated, there are three frame assemblies 14 mounted to a single rack 12. It should be appreciated, that there may be any number of frame assemblies 14 mounted to the rack 12 depending upon the size and configuration of the frame assembly 14 and/or rack 12. The rack 12 is supported on a conveyor system 16 such that the rack 12 and frame assemblies 14 are carried as a unit through a coating or plating process as will be discussed below.

The frame assemblies 14 support a plurality of workpieces 18 such that the workpieces 18 can be coated or plated with a material. Preferably, the workpieces 18 are metal parts that are to be coated or plated with zinc, nickel and/or chromate material. These types of materials are frequently used to coat metal parts to provide an improved appearance and/or enhanced corrosion resistance. Even more preferably, the workpieces 18 are relatively small metal parts such as nuts. The nuts are interconnected by at least one wire 20 (shown in FIG. 6) to form a strand of interconnected workpieces 18 (nuts) having first and second ends.

As shown in FIG. 1, the rack 12, frame assemblies 14, and workpieces 18 will be preferably dipped into a series of baths 22 to coat or plate the workpieces 18. As known to those skilled in the art and as discussed in greater detail below, the illustrated bath 22 is one of a series of baths 22 used in the coating or plating process. The specific method steps for coating or plating the workpieces 18 and the conductive nature of the rack 12 will be discussed in greater detail below.

Turning to FIGS. 3–7, the frame assembly 14 is now discussed in greater detail. The frame assembly 14 includes a rod 24 defining a longitudinal axis. The rod 24 is preferably formed of an electrically conductive material, such as copper, and is mounted directly to the rack 12. Even more preferably, the rod 24 attaches the entire frame assembly 14 to the rack 12.

Figure 3:
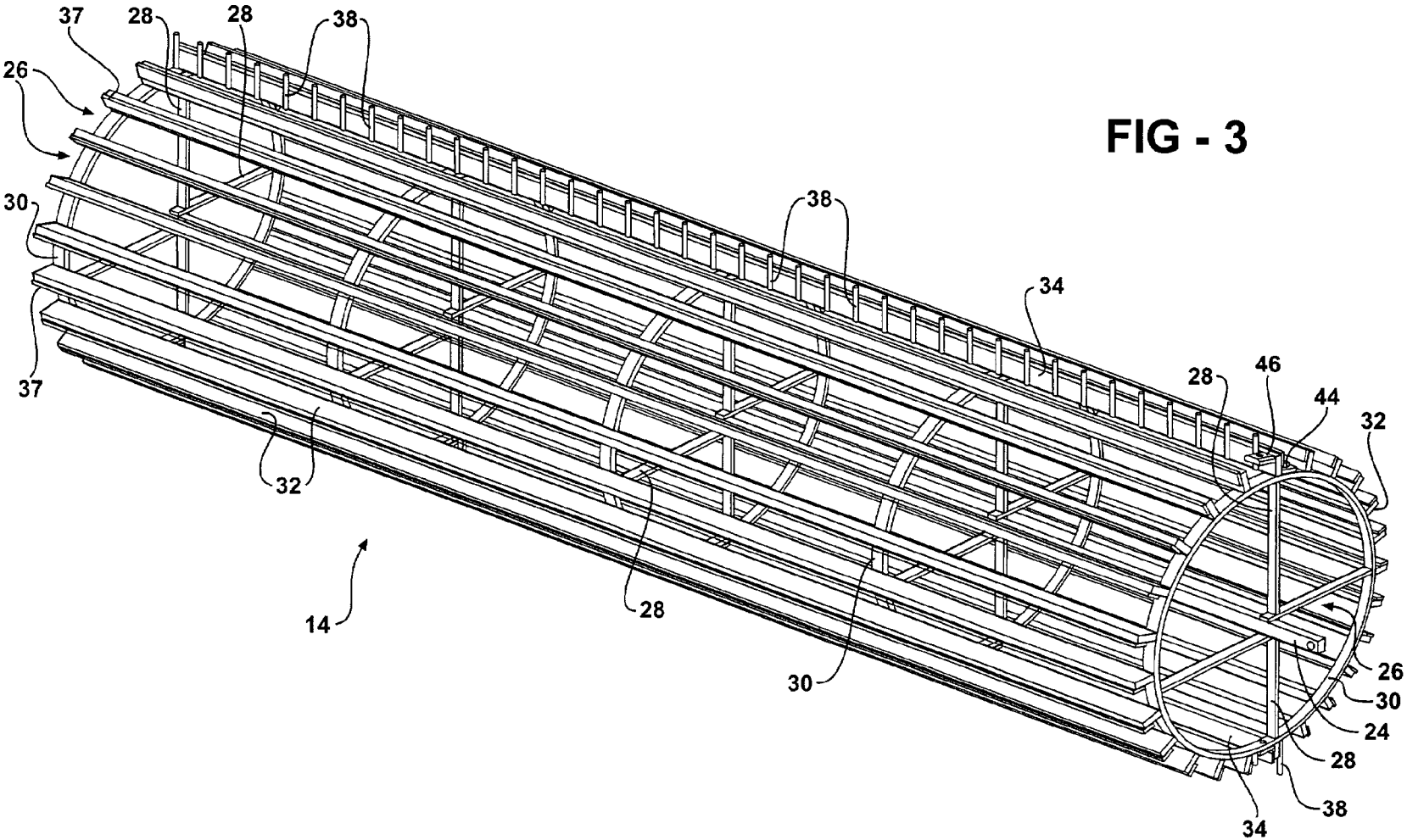
FIG. 3 is a perspective view of a frame assembly in accordance with the subject invention.

As best shown in FIGS. 3 and 7, a plurality of supports 26 are each mounted to the rod 24 and extend radially outwardly therefrom. The supports 26 are further defined as a plurality of separate support structures 26 mounted about the rod 24. Each of the support structures 26 include a plurality of struts 28 having first and second ends with the first ends mounted to the rod 24. Each of the support structures 26 also include a peripheral mount 30 connected to each of the second ends of the struts 28. Preferably, the peripheral mounts 30 are substantially circular such that the struts 28 extend in a spoke type fashion from the rod 24 to the peripheral mounts 30. Preferably, there are five support structures 26 with each support structure 26 having three struts 28. There is one strut 28 that extends continuously across the entire frame assembly 14 and two struts 28 that extend across half of the frame assembly 14. As is appreciated, there may be any suitable number of support structures 26 with any suitable number of struts 28 connected in any suitable manner.

As best shown in FIGS. 3 and 5–7, a plurality of bars 32, 34 are mounted to the supports 26. The bars 32, 34 interconnect the separate support structures 26 mounted about the rod 24. In particular, there are twenty-four bars 32, 34 attached directly to the circular peripheral mounts 30. As appreciated, there may be any number of bars 32, 34 as needed to adequately coat or plate the workpieces 18. Having the bars 32, 34 mounted to the circular peripheral mounts 30 orientates the bars 32, 34 in a substantially annular fashion about the rod 24. In addition, the bars 32, 34 extend axially relative to the rod 24 and are substantially parallel with the rod 24. This creates an open barrel configuration with the bars 32, 34 forming the exterior perimeter of the barrel. Extending above an outer surface 36 of each of the bars 32, 34 is an abutment member 37. Preferably, as illustrated, the abutment member 37 is a separate piece of material that is welded or otherwise affixed to the side of the bars 32, 34. The abutment member 37 can be flat, such as shown, round, or of any other configuration. Further, the abutment member 37 may be a narrowed or tapered portion of the bars 32, 34.

Figure 4:
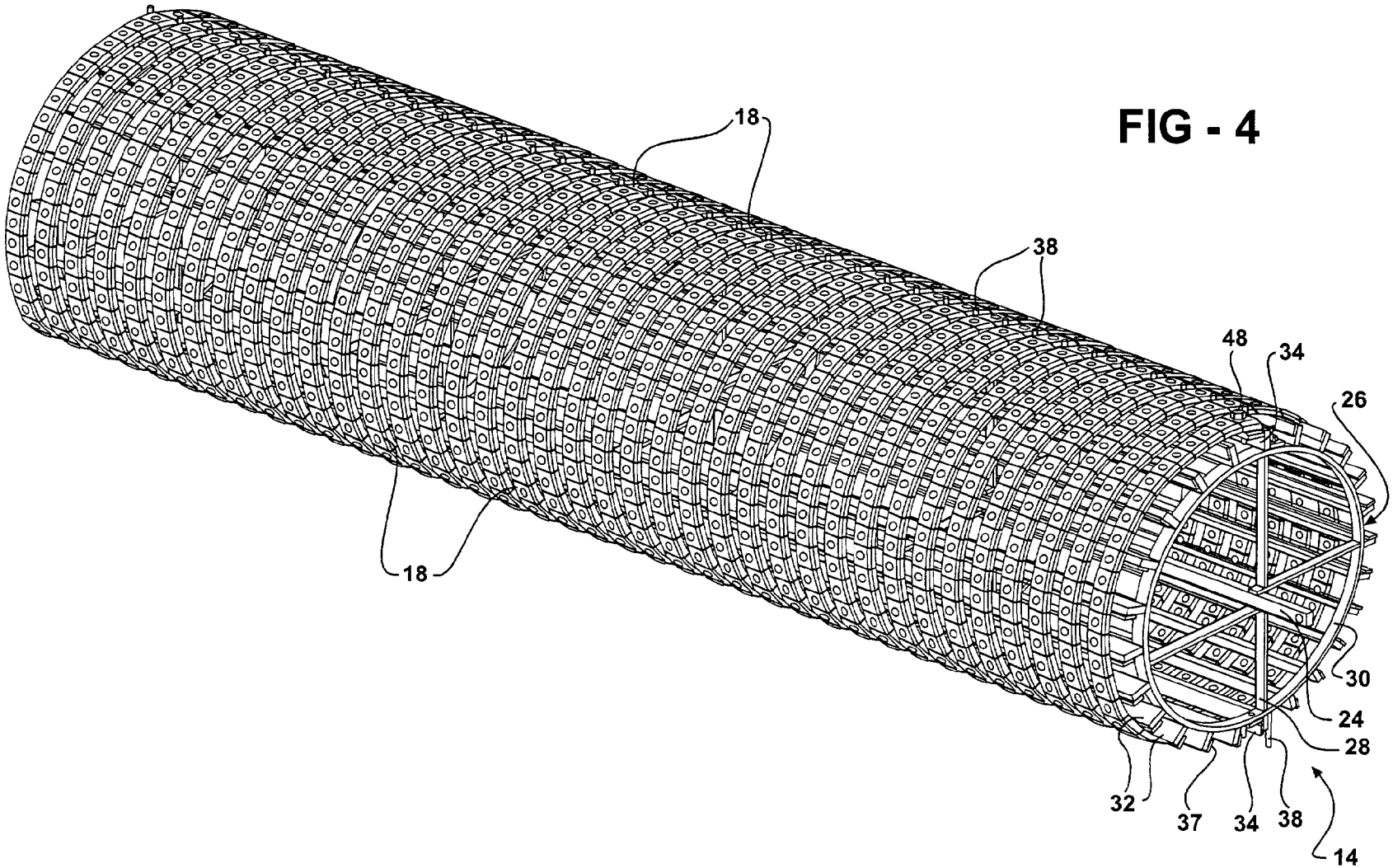
FIG. 4 is a perspective view of the frame assembly with a strand of workpieces disposed thereon.
Figure 6:
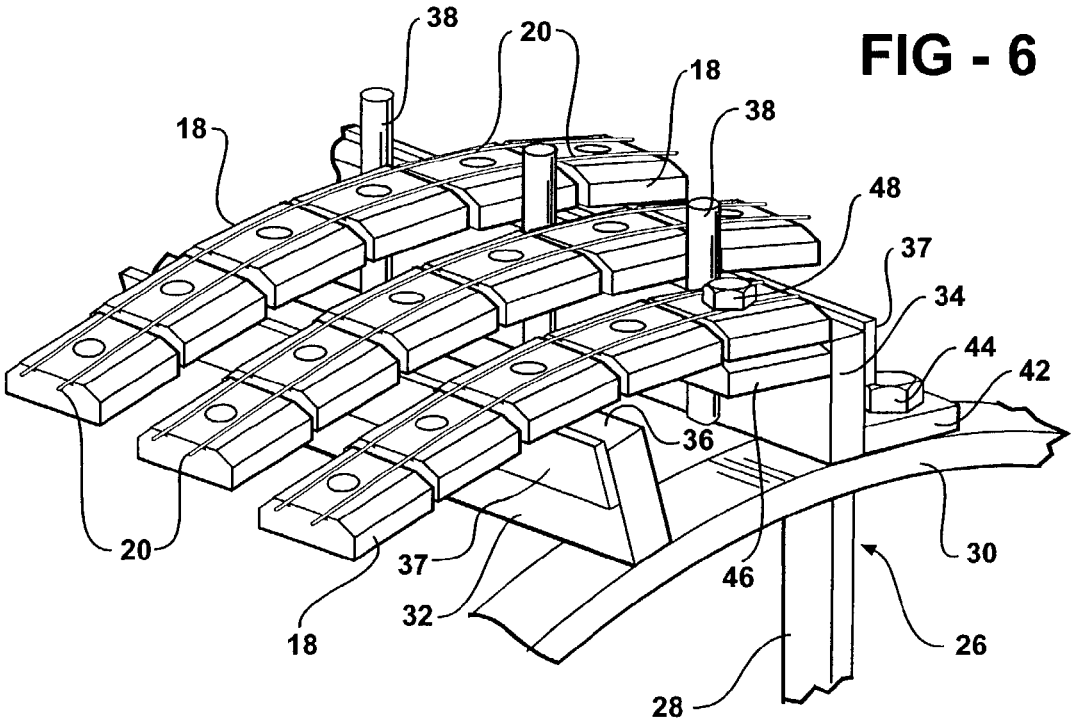
FIG. 6 is an enlarged fragmentary perspective view of the frame assembly with the strand of workpieces mounted thereto.

As best shown in FIGS. 4 and 6, the interconnected strand of workpieces 18 are wrapped over the bars 32, 34 to define a revolution of the interconnected workpieces 18 as is discussed in greater detail below. The interconnected workpieces 18 engage the abutment members 37 when the workpieces 18 are wrapped over the bars 32, 34. The abutment members 37 provide a narrower engagement surface for the workpieces 18 such that an underside of the workpieces 18 can be adequately coated with the material. As discussed above, the workpieces 18 are preferably nuts. As best shown in FIG. 4, the nuts 18 are preferably square nuts 18 interconnected together by two wires 20. The strand of workpieces 18 extending over the bars 32, 34 are forced into a substantially curved formation. In other words, adjacent workpieces 18, i.e., nuts, are slightly angled relative to each other such that adjacent surfaces 36 can be coated with the material.

The frame assembly 14, including the support structures 26, bars 32, 34, and abutment members 37, is preferably formed of an electrically conductive material, such as steel. Electrical current can then be passed from the copper rod 24, through the support structures 26, into the bars 32, 34 and abutment members 37, and to the strand of workpieces 18. Although not required, the importance of the preferred electrical conductivity will be discussed in greater detail below.

At least one of the bars 32 is preferably fixed to the supports 26 by being welded or otherwise being permanently affixed. As best shown in FIG. 3, the fixed bars 32 have distal ends which terminate at the full length of the frame assembly 14.

The plating apparatus 10 and frame assembly 14 are characterized by a plurality of spacers 38 mounted along at least one of the bars 32, 34 for separating adjacent revolutions of the interconnected workpieces 18 such that the workpieces 18 can be effectively coated with the material. The spacers 38 are shown in each of the Figures and are enlarged in FIGS. 5 and 6.

Preferably, at least one of the bars 34 is removable from the supports 26 and even more preferably the removable bar 34 includes the spacers 38. The preferred removable bar 34 having the spacers 38 is shown best in FIGS. 3 and 5–6. In the most preferred embodiment, there are two removable bars 34 and twenty-two fixed bars 32.

The removable bar 34 has opposing first and second distal ends which terminate at the length of the frame assembly 14. The removable bars 34 include at least one mounting aperture 40 disposed along a length thereof. Preferably, there is a mounting aperture 40 at each distal end and the mounting aperture 40 is part of an outwardly extending flange 42. A frame fastener 44 is selectively disposed within the mounting aperture 40 for attaching the removable bar 34 to the supports 26, see FIGS. 5 and 6. Preferably, the frame fastener 44 is a bolt.

A sample workpiece 46 is mounted, preferably welded, to the removable bar 34 adjacent each distal end. The sample workpiece 46 correlates to the strand of workpieces 18 that are to be wrapped over the frame assembly 14. A workpiece fastener 48 is selectively disposed within the sample workpiece 46 for attaching the strand of workpieces 18 to the removable bar 34, see FIG. 6.

The advantage of having the bars 34 with the spacers 38 being removable is that the frame assembly 14 can be easily modified to accept a wide variety of different shaped and sized workpieces 18. For example, the plurality of removable bars 34 can include at least a first removable bar 34 and a second removable bar 34. The first removable bar 34 includes a plurality of first spacers 38 and the second removable bar 34 includes a plurality of second spacers 38. Typically, only one of the first and second removable bars 34 will be attached to the supports 26 at any one time. The first plurality of spacers 38 are spaced apart along the first removable bar 34 by a first distance and the second plurality of spacers 38 are spaced apart along the second removable bar 34 by a second distance where the second distance is different from the first distance for allowing different sized workpieces 18 to be wrapped about the frame assembly 14. In addition, the sample workpieces 18 mounted to the first and second removable bars 34 will be different which creates a visual indicator to the user of which strand of workpieces 18 is being coated and ensures a proper mounting point for the strand of workpieces 18. The majority of the frame assembly 14 is therefore standardized and can be reused.

The spacers 38 are further defined as pins 38 mounted equidistantly apart along the removable bar 34. It should be appreciated that the spacers 38 may be of any suitable design or configuration and may be spaced apart in any suitable orientation.

Figure 5:
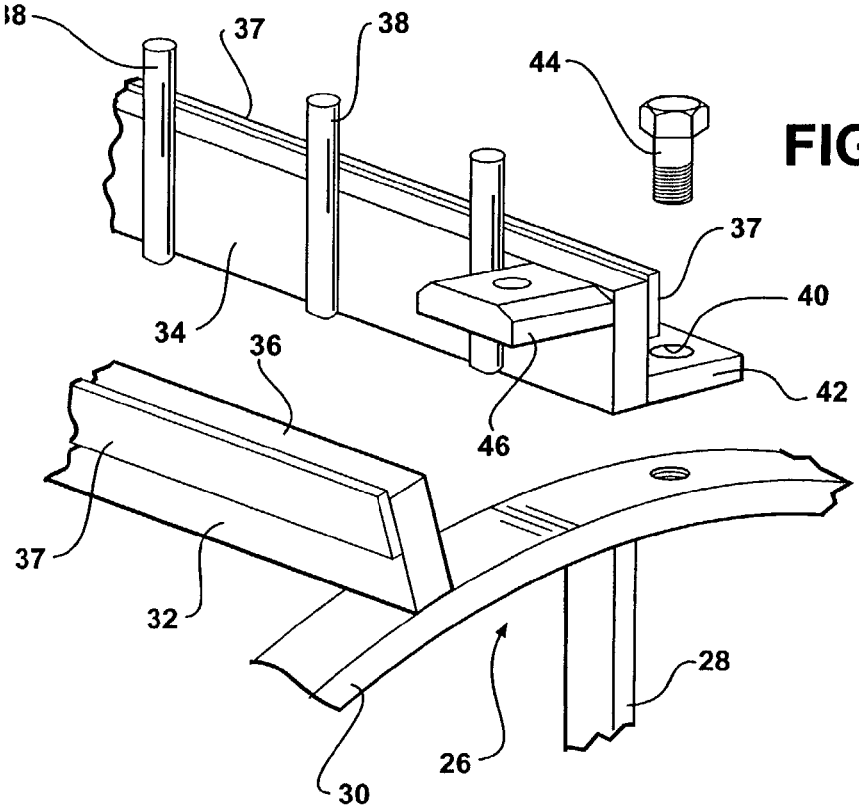
FIG. 5 is an enlarged fragmentary perspective view of the frame assembly illustrating the mounting of a removable bar.

A method of coating the strand of workpieces 18 will now be discussed in greater detail. The method comprises the steps of first selecting the correct removable bar 34 which correlates to the strand of workpieces 18 being coated or plated. As best shown in FIG. 5, these removable bar(s) 34, having the correct spacers 38 and sample workpieces 46, are mounted to the peripheral mounts 30 with the frame fasteners 44. The plurality of workpieces 18 are interconnected to define the strand of workpieces 18. The interconnection of the workpieces 18 is typically done prior to the removable bar 34 selection.

Figure 8:
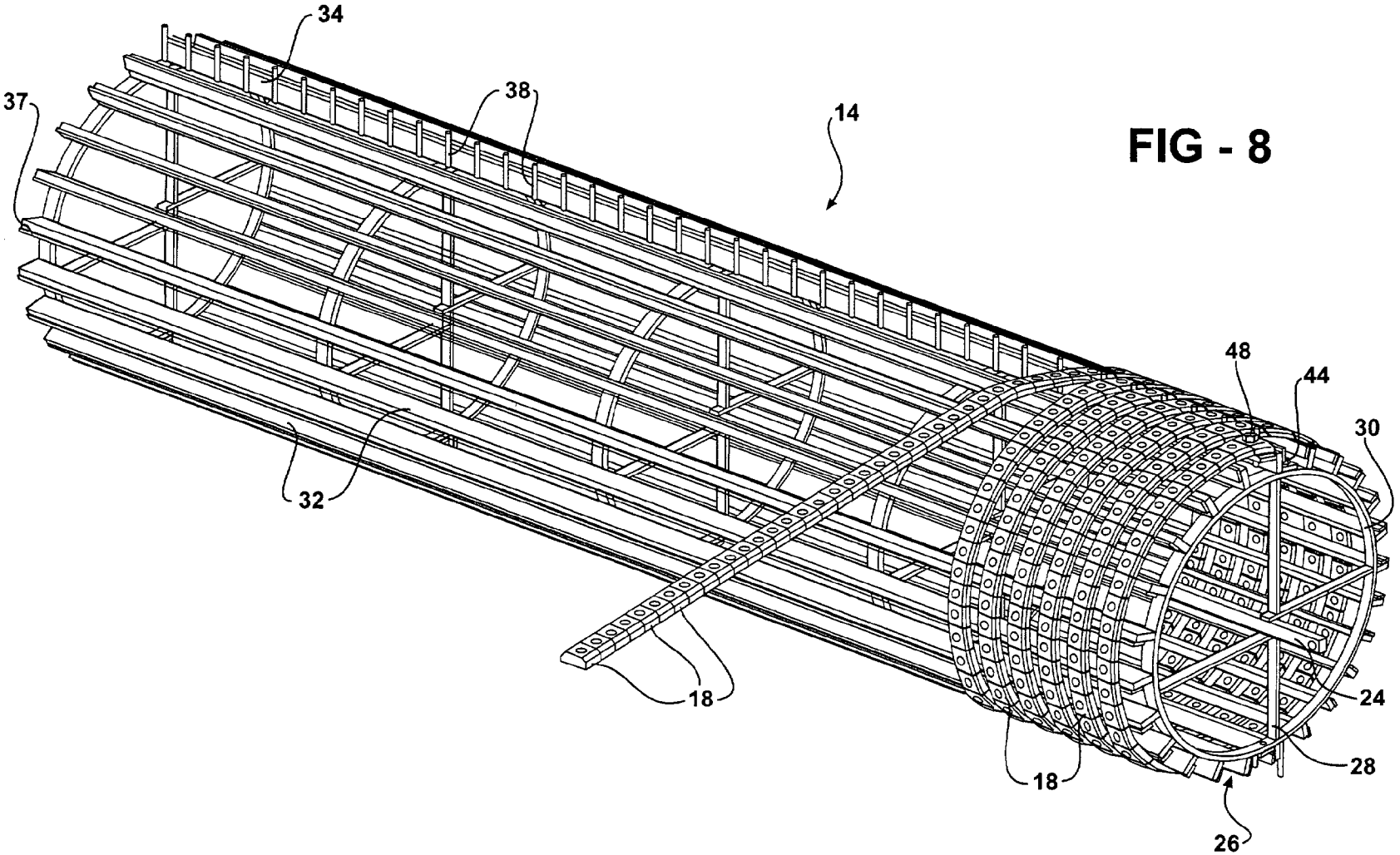
FIG. 8 is a perspective view of the frame assembly having the strand of workpieces being rolled thereupon.

As best shown in FIGS. 6 and 8, the first end of the strand is then mounted to the first distal end of the removable bar 34 by using the workpiece fastener 48. Preferably, the first end of the strand is mounted to the sample workpiece 46 by using the workpiece fastener 48. As discussed above, the workpieces 18 are nuts such that the workpiece fastener 48 would be a bolt which has the same thread pattern as the nuts.

As illustrated in FIG. 8, the strand is then wrapped over the abutment members 37 on the bars 32, 34 to define a revolution of the strand. Preferably, the frame assembly 14 is rolled and the strand of workpieces 18 are fed over the abutment members 37 and bars 32, 34 to facilitate the wrapping of the bars 32, 34. The strand is simultaneously wrapped between adjacent spacers 38 while being wrapped over the abutment members 37 and bars 32, 34 to simultaneously separate adjacent revolutions of the strand. The separation of the strands ensures that the workpieces 18 will be effectively coated with the material. After the frame assembly 14 is substantially wrapped with the strand of workpieces 18, as shown in FIG. 4, the second end of the strand is mounted to the opposite second end of the removable bar 34.

The frame assembly 14 is then mounted to the rack 12 and preferably a plurality of frame assemblies 14 are mounted to the rack 12, as shown in FIGS. 1 and 2. The plating apparatus 10 now has a rack 12 with one or more frame assemblies 14 which are fully wrapped with a strand of workpieces 18. The plating apparatus 10 is now ready for coating or plating the workpieces 18.

The frame assembly 14 and the strand of workpieces 18 is first pre-cleaned to loosen and remove soil, grease, and other debris from the workpieces 18. The pre-cleaning step can include soaking and electro cleaning as is known in the art. The frame assembly 14 and the strand of workpieces 18 is then pre-rinsed to remove the chemicals from the pre-cleaning step. The pre-rinsing cycle may be repeated and/or may be performed over a variety of different times. The frame assembly 14 and the strand of workpieces 18 can subsequently be acid washed to remove any metallic oxides followed by at least one additional rinsing step after the step of acid washing.

The frame assembly 14 and strand of workpieces 18 is now coated with the material. The step of coating the frame assembly 14 and strand of workpieces 18 with the material is further defined as electrostatically plating the frame assembly 14 and strand of workpieces 18 with the material. In particular, the frame assembly 14 and the strand of workpieces 18 is electrically charged during the step of coating the frame assembly 14. An electrical current is passed into the rack 12, through the copper rod 24, into the support structures 26, through the bars 32, 34 and the abutment members 37, and finally into the strand of workpieces 18. In the preferred embodiment, the frame assembly 14 and strand of workpieces 18 is plated with zinc or nickel which improves appearance and provides an enhanced corrosion resistance.

The frame assembly 14 and the strand of workpieces 18 can then again be rinsed after plating the frame assembly 14 and workpieces 18. Further, an additional acid wash may be performed to activate the outer surface of the workpieces 18.

The frame assembly 14 and strand of workpieces 18 can also be immersion coated with chromate to further enhance the appearance of the workpieces 18. The chromate material is offered in numerous forms as is known to those skilled in the art, such as clear/blue chromate and yellow chromate. The frame assembly 14 and the strand of workpieces 18 is rinsed again after immersion coating the frame assembly 14 and the strand of workpieces 18 with the chromate. A hot water rinse may also be performed.

The frame assembly 14 and the strand of workpieces 18 are then dried after coating the frame assembly 14 and strand of workpieces 18 with the material(s). The coated strand of workpieces 18 is now ready to be removed from the frame assembly 14. In particular, the strand of workpieces 18 is unwrapped from the frame assembly 14 to remove the coated strand of workpieces 18 from the frame assembly 14. Preferably, the frame assembly 14 is rolled in an opposite rotational direction than the rolling of the frame assembly 14 during the wrapping of the strand over the abutment members 37 and bars 32, 34.

As discussed above, the removable bars 34 may be interchanged by other removable bars 34 having spacers 38 with different configurations and/or distances. As such, the first and second removable bars 34 may be interchanged depending upon the size of the workpieces 18 for allowing different sized workpieces 18 to be wrapped about the frame assembly 14.

It should be appreciated that many of the specific steps set forth above can be eliminated, duplicated, re-ordered or the like without deviating from the overall scope of the subject invention so long as the workpieces 18 are adequately coated or plated. As such, many modifications and variations of both the assembly and method of the present invention are possible in light of the above teachings. Hence, the invention may be practiced otherwise than as specifically described within the scope of the appended claims, wherein reference numerals are merely for convenience and are not to be in any way limiting.

What is claimed is:

1. A method of coating a strand of workpieces (18), having a first end and a second end, with a material utilizing a frame assembly (14) having a plurality of supports (26), a plurality of bars (32, 34) attached to the supports (26), and a plurality of spacers (38) mounted along a length of at least one of the bars (32, 34), said method comprising the steps of;

mounting the first end of the strand to an end of one of the bars (32, 34);

wrapping the strand over the bars (32, 34) to define a revolution of the strand;

wrapping the strand between adjacent spacers (38) while wrapping the strand over the bars (32, 34) to simultaneously separate adjacent revolutions of the strand;

mounting the second end of the strand to an opposite end of one of the bars (32, 34); and coating the frame assembly (14) and strand of workpieces (18) with the material.

2. A method as set forth in claim 1 further including the step of interconnecting the plurality of workpieces (18) to define the strand of workpieces (18) before mounting and wrapping the strand.

3. A method as set forth in claim 1 wherein the step of wrapping the strand over the bars (32, 34) is further defined as rolling the frame assembly (14) and feeding the strand of workpieces (18) over the bars (32, 34).

4. A method as set forth in claim 1 wherein the bars (32, 34) are further defined as at least a first bar (34), having first spacers (38), and a second bar (34), having second spacers (38), with the first and second bars (34) both being removable from the supports (26), the first spacers (38) being spaced apart along the first removable bar (34) by a first distance and the second spacers (38) being spaced apart along the second removable bar (34) by a second distance were the second distance is different from the first distance, and further including the step of interchanging the first and second bars (34) depending upon the size of the workpieces (18) for allowing different sized workpieces (18) to be wrapped about the frame assembly (14).

5. A method as set forth in claim 1 further including a rack (12) and further including the step of mounting the frame assembly (14) to the rack (12) before the step of coating the workpieces (18) with the material.

6. A method as set forth in claim 5 further including the step of mounting a plurality of frame assemblies (14) to the rack (12).

7. A method as set forth in claim 5 further including the step of pre-cleaning the frame assembly (14) and the strand of workpieces (18).

8. A method as set forth in claim 5 further including the step of pre-rinsing the frame assembly (14) and the strand of workpieces (18).

9. A method as set forth in claim 5 further including the step of acid washing the frame assembly (14) and the strand of workpieces (18).

10. A method as set forth in claim 9 further including the step of rinsing the frame assembly (14) and the strand of workpieces (18) after the step of acid washing.

11. A method as set forth in claim 5 wherein the step of coating the frame assembly (14) with the material is further defined as electrostatically plating the frame assembly (14) and strand of workpieces (18) with the material.

12. A method as set forth in claim 11 further including the step of electrically charging the frame assembly (14) and the strand of workpieces (18) during the step of coating the frame assembly (14).

13. A method as set forth in claim 12 wherein the step of electrostatically plating the frame assembly (14) is further defined as plating the frame assembly (14) and strand of workpieces (18) with zinc.

14. A method as set forth in claim 12 wherein the step of electrostatically plating the frame assembly (14) is further defined as plating the frame assembly (14) and strand of workpieces (18) with nickel.

15. A method as set forth in claim 11 further including the step of rinsing the frame assembly (14) and the strand of workpieces (18) after plating the frame assembly (14).

16. A method as set forth in claim 5 wherein the step of coating the frame assembly (14) with the material is further defined as immersion coating the frame assembly (14) and strand of workpieces (18) with chromate.

17. A method as set forth in claim 16 further including the step of rinsing the frame assembly (14) and the strand of workpieces (18) after coating the frame assembly (14) and the strand of workpieces (18).

18. A method as set forth in claim 5 further including the step of drying the frame assembly (14) and the strand of workpieces (18) after coating the frame assembly (14) and strand of workpieces (18) with the material.

19. A method as set forth in claim 5 further including the step of unwrapping the strand of workpieces (18) from the frame assembly (14) to remove the coated strand of workpieces (18) from the frame assembly (14).

20. A method as set forth in claim 19 wherein the step of unwrapping the strand is further defined as rolling the frame assembly (14) in an opposite rotational direction than the rolling of the frame assembly (14) during the wrapping the strand over the bars (32, 34).

* * * * *

UNITED STATES PATENT AND TRADEMARK OFFICE

CERTIFICATE OF CORRECTION

PATENT NO. : 7,052,740 B2
APPLICATION NO. : 10/255827
DATED : May 30, 2006
INVENTOR(S) : Todd McNulty It is certified that error appears in the above-identified patent and that said Letters Patent is hereby corrected as shown below:

Column, line 21 delete the first occurrence of "were" and replace it with -- where --.

Column 8, line 39 before the first occurrence of "is" please insert -- of workpieces (18) --.

Column 8, line 41 before the third occurrence of "the" please insert -- of --.

Column 8, line 42 before the first occurrence of "over" please insert -- of workpieces (18) --.

Signed and Sealed this

Nineteenth Day of December, 2006

JON W. DUDAS
*Director of the United States Patent and Trademark Office*